US005159303A

United States Patent [19]

Flink

[11] Patent Number: 5,159,303

[45] Date of Patent: Oct. 27, 1992

[54] TEMPERATURE COMPENSATION IN A HELIX RESONATOR

[75] Inventor: Pekka T. Flink, Kempele, Finland

[73] Assignee: LK-Products, Kempele, Finland

[21] Appl. No.: 694,782

[22] Filed: May 2, 1991

[30] Foreign Application Priority Data

May 4, 1990 [FI] Finland ..... 902263

[51] Int. Cl.[5] ..... H01P 7/00

[52] U.S. Cl. ..... 333/219; 333/234

[58] Field of Search ..... 333/174–176, 333/202, 219, 234, 231, 227, 229, 235, 212

[56] References Cited

U.S. PATENT DOCUMENTS 3,247,475 4/1966 Buetow et al. ..... 333/231
3,621,484 11/1971 Shult ..... 333/202
4,205,286 5/1980 Parish ..... 333/234 X

FOREIGN PATENT DOCUMENTS 0150971 9/1981 Fed. Rep. of Germany ..... 333/202

*Primary Examiner*—Eugene R. LaRoche

*Assistant Examiner*—Seung Ham

*Attorney, Agent, or Firm*—Banner, Birch, McKie & Beckett

[57] ABSTRACT

The stop-band and pass-band frequencies of a duplex filter which includes a plurality of helix resonators must not change when the temperature changes. Therefore the resonators used must be temperature compensated. One known method is to injection-mold plastic bonds (3, 8) to the cover (2) of the resonator shield in such a way that the last turns of the helical coil (4) of the resonator are inside the bond (3, 8). Through a suitable selection of the bonding material it is possible in part to compensate for changes in the distance between the open end of the resonator coil and the cover of the shield and for changes in the pitch of the turns of the conductor (4) wound into a helical coil and in the coil length. In practice this compensation is undercompensated in character. According to the invention it is possible, by making one interval (pitch) (7) between the free turns of the coil greater than the others, to make the temperature compensation just right.

3 Claims, 1 Drawing Sheet

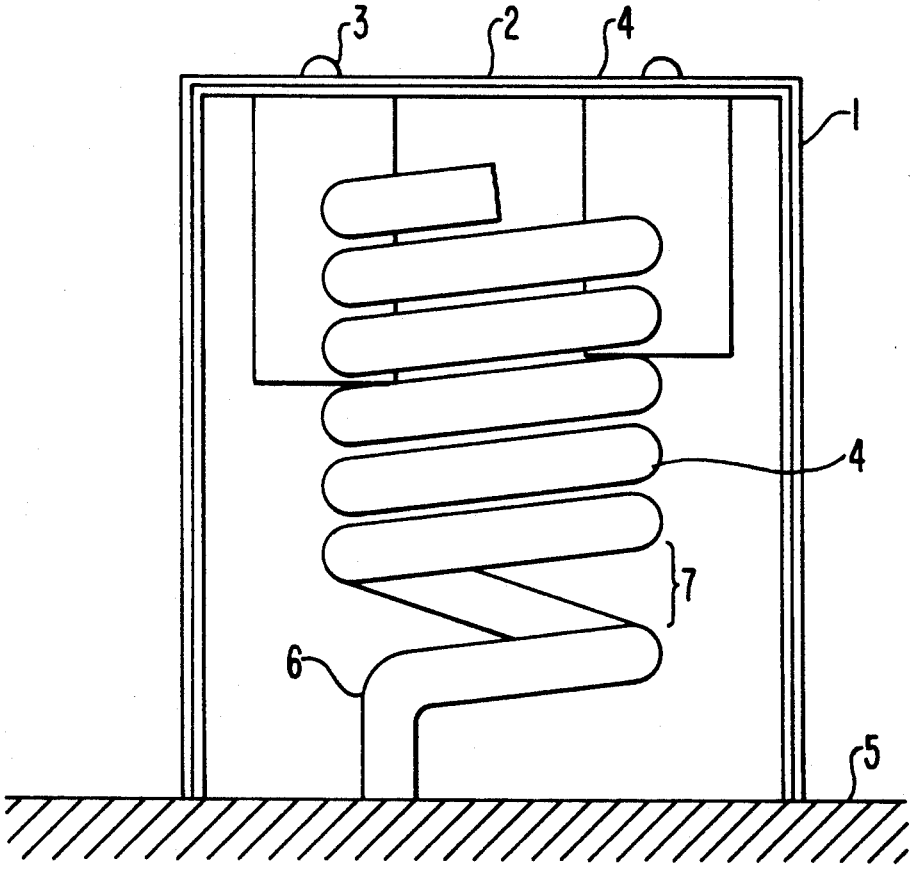
3
2
4
1
4
7
6
5

TEMPERATURE COMPENSATION IN A HELIX RESONATOR

BACKGROUND OF THE INVENTION

1. Field of the Invention

The present invention relates to temperature compensation in a helix resonator.

2. Description of Related Art

It is known that the inner conductor of a helix resonator is wound into a cylindrical coil, and the outer conductor consists of a conductive surface which covers the cylindrical coil. At the resonant frequency, TEM vibration is formed along the longitudinal axis of the resonator. The signal enters the cylindrical coil at its one end, and the other end may be either open or short-circuited. If the other end is open, the helix resonator is equivalent to a quarter-wave coaxial resonator, and if the other end is short-circuited, the helix resonator is equivalent to a half-wave coaxial resonator. By regulating a suitable tuning screw in the resonator structure, the capacitance between the coil and the shield can be adjusted to form an LC series resonance circuit. Usually a plurality of resonators are coupled together in such a manner that a filter having the desired properties is obtained for use, for example, in a radio receiver. Owing to their relatively small size and tunability, helix resonators are highly usable in duplex filters, especially within a frequency range of 100–1000 MHz. Temperature stability constitutes a basic problem in state-of-the-art helix resonators. The stop-band and pass-band frequencies of a duplex filter must not change, for example under the effect of the temperature. Therefore the helix resonators in a duplex filter should be temperature compensated, i.e. their resonant frequency must not vary as a function of the temperature. In applications in which the variation of ambient temperature is wide, substantial deviations in the average frequency of a helix resonator are to be expected. A typical example of such an application is the duplex filter used in mobile telephones. In the state of the art, frequency deviation caused by a change in the temperature has been compensated in various ways. It is possible to use precision components the properties of which are very little affected by temperature changes. However, the use of such components makes the resonator very expensive. Another method is to make resonators tunable over so wide a range that extensive temperature deviations from the average frequency can be allowed. This method is, however, less desirable, since it is carried out at the expense of selectivity. In certain applications, improvement of temperature sensitivity takes place at the expense of tuning sensitivity.

U.S. Pat. No. 4,205,286 describes a temperature-stabilized helix resonator. In this construction the inner conductor is wound around a two-part frame, in which the parts of the frame are coaxial and successive, and the lower part has a greater diameter than the upper part, and the lower part and the upper art are interconnected by means of a flexible joint which allows the parts to move in relation to each other as the temperature changes. Inside the smaller-diameter upper part there extends an adjusting screw, which serves as a tuning element and is supported on the one hand by a threading in the upper part and on other hand by the cover of the shield, with the help of a locking nut. As the ambient temperature changes, the joint between the upper part and the lower part enables these parts to move in relation to each other, but so that the distance of the tuning screw from the conductor coils in the upper part always remains the same, whereupon the capacitive coupling also remains the same regardless of the ambient temperature. The construction of the temperature-stabilized resonator described in this patent application is quite cumbersome and expensive to manufacture, and is rather large in size and has a rather low Q-value, and thus it is suitable for use at rather low frequencies, approx. 100–200 MHz.

Also known is a temperature compensation method in which plastic bonds are injection-molded to the cover of the helix resonator shield. Such a bond comprises one or more projections oriented towards the resonator axis from the cover of the resonator shield, one end of the projections being, as mentioned above, fixed to the resonator shield and the other end extending in part over the topmost turns of one or more resonators in such a manner that the conductor of the resonator coil is in part or entirely inside these projections. Instead of projections it is possible to use one ring-like cylindrical piece, one end surface of which rests tightly against the cover of the resonator shield, and the topmost turns of the resonator coil are within this cylindrical piece. When the temperature increases, the distance of the open end of the resonator from the shield cover changes, and owing to the thermal expansion the length of the coil and the pitch of the turns change. By selecting a suitable material for the projections, an attempt can be made to compensate for the above-mentioned changes. In practice such temperature compensation is undercompensated in character, and this means that the frequency will change somewhat as a function of the temperature. Temperature compensation can be corrected by shifting the undercompensation in the direction of overcompensation to a suitable extent so that, as the temperature changes, the result will, nevertheless, be precise temperature compensation and the frequency will not change as a function of the temperature. The methods of correction have included bringing the open end of a helix resonator closer to the cover of the upper side, or reducing the pitch of the helix resonator, i.e. the distance between the turns, in the area of the abovementioned bonds, or the temperature coefficient of the plastic can be increased.

Bringing the open end of the helix resonator closer to the cover will be helpful only to a certain limit, i.e. the temperature compensation will no longer change in the overcompensated direction even if the resonator end is brought infinitely close to the cover. Bringing the open end of a helix resonator infinitely close to the cover also involves another disadvantage, i.e. the risk of electric breakdown, and such breakdown is possible especially at high voltage levels. It should also be noted that, after a certain optimum distance, the Q-value of the resonance circuit will drop the more the closer to the resonator shield cover the open end of the helix resonator is brought.

As mentioned above, a resonator undercompensated with respect to the temperature can be shifted in the overcompensated direction by reducing within the bound part the pitch of the helix resonator, i.e. the distance between the turns. A practical limit to this method is set by the fact that the turns must not touch each other, and since the turns are in practice already very close to each other the leeway for reducing the distance is very slight. A third possibility in shifting in the overcompensated direction is to increase the temperature coefficient of the plastic, but this is limited by the fact that the number of plastics which can be used is small, since the plastic is required to have also properties other than good temperature properties, and therefore the number of temperature coefficients usable is limited.

SUMMARY OF THE INVENTION

The present invention introduces a method for temperature compensation in a helix resonator, eliminating the disadvantages of the methods mentioned above. The method presented is simple and easy to implement, and it is characterized in what is stated in the characterizing clause of claim 1.

According to the basic idea of the invention, temperature compensation in a helix resonator is carried out through measures aimed at the intervals between the free turns near to the low impedance end of the helical coil, and not through measures aimed at the intervals near to the high impedance free end of the coil. These turns at the high impedance end can be within a bound supporting the coil to the cover of the resonator shield or they can as well be without any external supporting member. So compensation is not carried out through measures aimed at the distance of the free end of the helix resonator from the cover of the shield.

BRIEF DESCRIPTION OF THE DRAWING

The invention is described in greater detail with reference to the accompanying FIGURE, which depicts a cross section of a helix resonator.

DESCRIPTION OF THE PREFERRED EMBODIMENT

The FIGURE depicts such an embodiment in which the last turns in the high impedance end of the helical coil are within a bond but the resonator can be manufactured also without bond or any other fixing member.

The construction depicted in the FIGURE comprises a cylindrical coil 4, which is surrounded by a conductive cover comprising an axially cylindrical or polygonal mantle 1 and an end surface 2, which is of the same material as the mantle. The mantle and the end surface are metallic or metallized. The last turns of the free end of the cylindrical coil are secured to the end surface 2 by injection molding plastic bonds 3 and 8 so that, on the one hand, the bonds are fixed to the end surface 2 of the resonator shield and, on the other hand, the bonding material in the area of the bonds encircles the last turns of the coil. The other end of the resonator cover is closed by a support plate 5, which may be, for example, part of the circuit board, and the resonator leg bears against this plate 5. In resonator coils according to the prior art, the pitch of the coil, i.e. the distance of the individual turns from each other, always remains the same. In this construction according to the prior art, the bonds 3 and 8 which support the upper part of the helix resonator have the effect that, as the temperature changes, the distance of the open end of the coil from the surface 2 of the shield will change to compensate for any change in the coil length. As was stated above, such temperature compensation is undercompensated in character, i.e. the frequency tends to change somewhat as a function of the temperature. Now, when the ambient temperature increases, it will cause thermal expansion of the resonator coil, whereupon its free turns will press closer to each other. This pressing of the free turns of the resonator coil closer to each other will cause a change in the coil length. This effect of the change can, according to the invention, be reduced by making one of the intervals between the free turns of the coil, for example interval 7, greater than the others, which will have the effect that, upon a change in the temperature, the compensation of the coil will change in the overcompensated direction. Thus it is possible, according to the invention, by adjusting in advance one interval between the free turns to a suitable size, to make the temperature compensation just right. It is advantageous to select as this interval one which is at quite the beginning of the resonator, preferably the interval between the first and the second turns, since as the temperature increases and the free turns of the resonator coil press closer to each other, the change will be greatest here.

Temperature compensation according to the invention in a helix resonator is very simple to implement, and it can advantageously be applied to any constructions in which the open end of the resonator coil is supported against the resonator shield cover by means of insulator bonds.

By applying the invention to the construction without any support or fixing member at the high impedance end of the helix it has been achieved also other surprising advantages in addition to temperature compensation. A great advantage is that variations in the physical dimensions of the helical coil do not influence so strongly to the resonant frequency and other electrical properties i.e. the diameter of the inner conductor wire and the height of the coil can be varied in some limits without changes in the resonant frequency. This makes fabrication of resonators and filters more easy and less accuracy is needed in winding of a wire to form a inner conductor.

I claim:

1. A temperature-compensated helix resonator comprising:

a cover; and a helical coil disposed within the cover, a first end of the helical coil being open and at a distance from the cover and a second end of the helical coil having a connection to the cover, wherein the first end of the helical coil is wound with a first pitch and at least one turn of the helical coil at the second end is wound with a second pitch, the second pitch being greater than the first pitch.

2. A temperature-compensated helix resonator according to claim 1, wherein the at least one turn having the second pitch is the at least one turn closest to the connection to the cover.

3. A temperature-compensated helix resonator according to claim 1, wherein the first end of the helical coil being rigidly fixed to the cover by an insulator so that at least one turn of the first end of the helical coil is formed within the insulator.

* * * * *